United States Patent [19]

Lamb

[11] 4,321,447

[45] Mar. 23, 1982

[54] ENERGIZATION CIRCUIT FOR A MICROWAVE OVEN

[75] Inventor: John T. Lamb, Mansfield, Ohio

[73] Assignee: The Tappan Company, Mansfield, Ohio

[21] Appl. No.: 176,192

[22] Filed: Aug. 7, 1980

[51] Int. Cl.[3] ..... H05B 6/68

[52] U.S. Cl. ..... 219/10.55 B; 219/10.55 C; 219/505; 361/99; 361/165; 307/141.4; 307/135; 315/104; 323/908

[58] Field of Search ..... 219/10.55 B, 10.55 C, 219/505, 504; 361/194, 94, 99, 165, 118; 331/86, 87; 328/259, 270; 307/141, 141.4, 135, 132 T; 315/102, 104; 323/908

[56] References Cited

U.S. PATENT DOCUMENTS

| | | | |
|---|---|---|---|
| 3,017,564 | 1/1962 | Barney | 323/908 X |
| 3,392,309 | 7/1968 | Hickman | 219/10.55 B |
| 3,460,126 | 8/1969 | Spofford et al. | 361/99 X |
| 3,821,594 | 6/1974 | Webb et al. | 219/10.55 B |
| 3,842,233 | 10/1974 | Lamb | 219/10.55 |
| 4,011,427 | 3/1977 | Risman | 219/10.55 B |

OTHER PUBLICATIONS

U.S. Patent application Serial No. 177,777 filed Aug. 13, 1980.

*Primary Examiner*—B. A. Reynolds
*Assistant Examiner*—Philip H. Leung
*Attorney, Agent, or Firm*—Maky, Renner, Otto & Boisselle

[57] ABSTRACT

An energization circuit for a microwave oven employs a PTC thermistor to eliminate high transient current surges resulting from energization and deenergization of induction elements therein to provide circuit protection both during oven start and operation. The energization circuit comprises first and second parallel circuit portions for energizing a transformer used to energize a magnetron that produces microwave energy, the first circuit portion including a normally open start switch and a current limiting PTC thermistor coupled in series relation and the second circuit portion including a relay operated switch, a relay for operating the relay operated switch, and a relay circuit portion connected to the first circuit portion between the start switch and PTC thermistor for energizing the relay upon closure of the start switch and then through the PTC thermistor upon opening of the start switch. During start-up, power is briefly supplied to the magnetron through the PTC thermistor to reduce high current surge flow to the transformer until the relay operated switch closes and supplies full power to the transformer and thus to the magnetron. The relay first is energized directly through the start switch upon closure of the latter and then by reverse current flow through the PTC thermistor upon closing of the relay operated switch and opening of the start switch.

4 Claims, 1 Drawing Figure

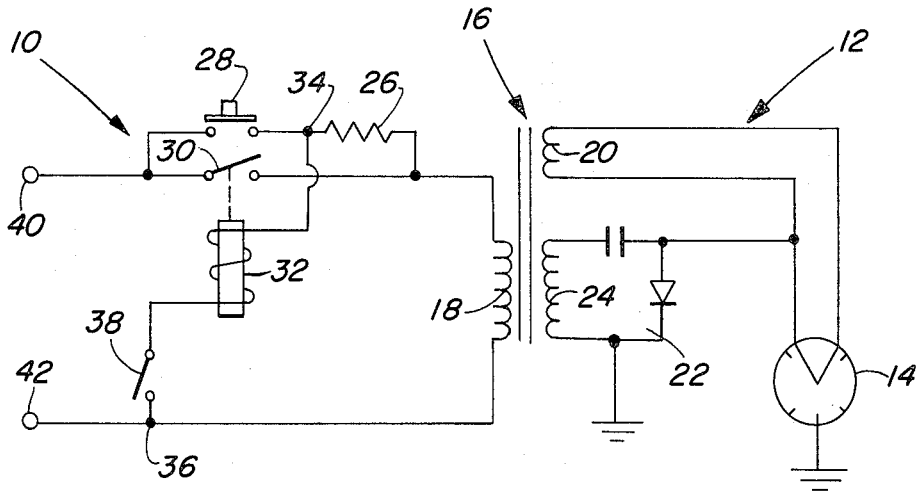
10
28
34
26
16
12
30
20
40
32
24
18
38
22
42
14
36

ENERGIZATION CIRCUIT FOR A MICROWAVE OVEN

This invention relates generally to a microwave oven, and more particularly to a circuit for energizing the microwave generator or magnetron therein.

BACKGROUND

In conventional microwave ovens, a magnetron energized through a transformer coupling produces microwave energy, i.e., high frequency electromagnetic energy, to cook food within the oven cooking cavity therein. When starting such an oven, a high transient current initially is drawn by the transformer. Such high current surge poses a problem in that it subjects the other components in the energization circuit to possible damage, such as, for example, by welding switch contacts together or unnecessarily burning-out the safety fuses in the circuit. Moreover, the high starting current constitutes a start-up shock to the magnetron which shortens its effective useful life.

It has been found that the high current pulse during starting of the microwave oven can be avoided by using a start switch in series connection with a current limiting or protective resistor in the energization circuit for the magnetron to provide a low starting current therefor, and a relay having a small inherent delayed response coupled across the energization circuit which operates a switch connected in parallel circuit relation with such series circuit for bypassing the protective resistor shortly after the magnetron is energized. In this manner, the current drawn by the magnetron during starting does not reach an excessive level.

One drawback of known energization circuits of this type is that there is a risk of burning the protective resistor in the event the protective resistor is overloaded or subjected to high current for too long a duration, such as, for example, when the start switch is held closed and the relay switch fails to close or is held open by another switch or control.

It has been suggested in U.S. Pat. No. 4,011,427 to use a PTC thermistor, i.e., a thermistor having a positive temperature coefficient, as the protective resistor. On occasion of a fault in the relay coil, the PTC thermistor is heated rapidly, when the start switch is closed, resulting in a rapid increase in resistance and decrease in current through the thermistor. The thermistor is thus not damaged by such fault in the circuit during oven start-up. However, with the energization circuit disclosed in such patent the PTC thermistor only has a useful function during oven start-up. Once the relay operated switch closes and the start switch opens, the thermistor is thereafter bypassed. Accordingly, the thermistor offers no protection to the circuit such as in the event, for example, of a relay failure occurring after the relay operated switch closes. Also such energization circuit may cause an undesirable delay in oven restart even though no malfunction exists in the circuitry, which can be an irritation to the oven user. In addition, the possibility exists of a high current pulse being delivered to the magnetron due to reverse voltage kick emanating from the relay when the oven is shut off such as upon opening of the main supply switch therefor.

SUMMARY OF THE INVENTION

The present invention provides an improved energization circuit for a microwave oven by which many of the drawbacks in known energization circuits are eliminated and new and advantageous results are obtained. In the preferred embodiment described herein, the energization circuit employs a PTC thermistor to eliminate high transient current surges resulting from energization and deenergization of the inductive elements therein and to provide circuit protection both during oven start and operation. More specifically, the energization circuit comprises first and second parallel circuit portions connecting a source of electrical energy to a transformer used to energize the magnetron, the first circuit portion including a normally open start switch and a current limiting PTC thermistor coupled in series relation and the second circuit portion including a relay or similarly operated switch, a relay or other mechanism for operating the relay operated switch, and a third or relay circuit portion connected to the first circuit portion between the start switch and PTC thermistor for energizing the relay upon closure of the start switch and then through the PTC thermistor by reverse current flow or more precisely current flow in the opposite sense when alternating current is employed upon opening of the start switch. The PTC thermistor not only protects the energization circuit against damage due to high current surge resulting from oven start-up or shut-off, but also protects itself against system failure, the thermistor upon overloading, heating up and reducing its own current flow to a safe value as well as that being supplied to other circuit elements, both during oven start-up and operation.

To the accomplishment of the foregoing and related ends, the invention, then, comprises the features hereinafter particularly pointed out and distinctly claimed in the claims, the following description and the annexed drawing setting forth in detail a certain illustrative embodiment of the invention, this being indicative, however, of but one of the various ways in which the principles of the invention may be employed.

BRIEF DESCRIPTION OF THE DRAWING

In the annexed drawing, there is illustrated a schematic electric circuit diagram of an energization circuit for a microwave oven according to the present invention.

DETAILED DESCRIPTION

Referring now more specifically to the drawing, an electric energization circuit for a microwave oven is shown generally at 10, and is connected to an output circuit 12 for energizing the magnetron 14 of the oven. The output circuit 12 includes a coupling transformer 16 having a primary winding 18 coupled to the energization circuit 10 and a first secondary winding 20 providing heater energization in the magnetron 14. The output circuit 12 further includes a circuit 22 including a second secondary winding 24 providing high voltage energization for the magnetron.

In the energization circuit 10, there is included a series coupled current limiting or protective resistor 26, which according to the invention is a PTC thermistor, and a start switch 28, the latter being, for example, a normally open push-button type switch. A normally open relay operated switch 30 is coupled in parallel with such series circuit, i.e., the protective thermistor 26 and the start switch 28, and is closed by energization of a relay 32. The relay 32 is connected to the series circuit at the node 34, representing the connection point of the start switch 28 and thermistor 26, and the neutral side of the energization circuit at node 36 through an oven control or shut-off switch 38. The shut-off switch 38 may be, for example, an interlock safety switch, a timer operated switch or otherwise controlled switch.

In operation of the energization circuit 10, the circuit input terminals 40, 42 are connected to a supply of electrical power whereupon closure of start switch 28 provides current through the PTC thermistor 26 to the primary winding 18 of the coupling transformer 16 to energize the output circuit 12 and thus the magnetron 14. Also upon closure of the start switch 28, current flows from the node 34 through relay 32, provided switch 38 is closed, to close the relay operated switch 30 thereafter to supply full power to the magnetron 14. Accordingly, a small current will pass through the start switch 28 and thermistor 26 to the output circuit 12 prior to application of full power for a period equal to the delay time required to energize the relay 32 and close the relay operated switch 30, such operation protecting the magnetron and energization circuit from high transient current surge during start-up.

When the start switch 28 is returned to its normally open position, the relay 32 initially energized through the start switch will thereafter be maintained energized by reverse current flow or more precisely by current flow in the opposite sense through the PTC thermistor 26 when alternating current is employed. Since only maintenance of the relay in its energized or actuated state is required, the holding current therefor will be low and will not cause substantial heating of the thermistor. However, such low current advantageously will cause some heating of the thermistor such as to its anomaly point to assure rapid response in the event of a failure in the circuit or to insure adequate protection to the circuit.

In the event of substantial current flow through the PTC thermistor 26 as may occur if the start switch 28 is closed and the shut-off switch 38 is open, instead of overloading and burning out, the thermistor will heat up and reduce its own current flow to a safe level. Similar protection is obtained if the start switch is held closed and the relay 32 is open circuited and thus fails to close the relay operated switch 30.

It also should be understood that the PTC thermistor 26 protects itself and the energization circuit during operation of the oven after start-up has been achieved. If for example during operation the relay 32 short circuits but the switch 30 remains closed, for example, the thermistor will heat up and limit current flow to the relay to protect the relay against further damage as well as protect itself against damage. Moreover, such heating up of the thermistor and resultant current reduction will occur rapidly upon incidence of the short circuit as the thermistor will have already been partially heated such as to its anomaly point whereafter resistance increases rapidly with respect to temperature rise thereby protecting the relay against possible extensive and hazard-causing damage.

It also will be appreciated that the oven can be started frequently in a short period of time in contrast to the above-mentioned circuit disclosed in U.S. Pat. No. 4,011,427. In such patent, each start causes the thermistor to heat up, and if sufficiently hot will not permit enough current to pass to energize the relay therein for closing the full power or by-pass switch. In the present circuit, energization of the relay 32 is achieved at full power regardless of the number of previous starts. Even though the thermistor 26 may be elevated in temperature as a result of many frequent starts, it generally will pass enough current to maintain the relay energized, although it might not have passed enough current initially to energize the relay.

It should now be clear that there is provided an improved energization circuit for providing power to the magnetron in a microwave oven, such circuit being protected against transient current surges resulting from energization and deenergization of inductive elements therein and also against circuit failure both during oven start and operation. While the invention is illustrated in a preferred but simple electrical circuit, it should be understood that the principles of the invention may be employed in a more sophisticated circuit employing further elements such as safety switches and interlock switches, cycling controls, power level controls, fuses, timers, temperature responsive switches and the like.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the claims.

The embodiments of the invention in which an exclusive property or privilege is claimed are defined as follows:

1. An energization circuit for a microwave oven in which high frequency energy is emitted by a high frequency generator, comprising first and second parallel circuit portions for connecting a source of electrical energy to the generator, said first circuit portion including a first normally open switch and a current limiting PTC thermistor coupled in series relation and said second circuit portion including a second normally open switch, actuator means upon energization thereof for closing said second switch in delayed response to such energization, and circuit means connected to said first circuit portion between said first switch and said PTC thermistor for energizing said actuator means directly with current flow through said first switch upon closure of said first normally open switch to close said second switch and then with current flow in the opposite sense through said PTC thermistor upon opening of said first switch and the closing of said second switch.

2. The circuit of claim 1 further comprising a control switch in said circuit means for opening said circuit means and deenergizing said actuator means for closing to open said second switch.

3. The circuit of claim 1 wherein said actuator means comprises a member which is movable upon energization of said actuator means to close said second switch.

4. The circuit of claim 3 wherein said actuator means comprises a relay and said circuit means is a relay circuit.

* * * * *